US005751103A

United States Patent [19]

Opresko et al.

[11] Patent Number: 5,751,103

[45] Date of Patent: May 12, 1998

[54] COLOR PICTURE TUBE HAVING IMPROVED FUNNEL

[75] Inventors: Stephen Thomas Opresko; Richard Wayne Hutzler, both of Lancaster, Pa.

[73] Assignee: Thomson Consumer Electronics, Inc., Indianapolis, Ind.

[21] Appl. No.: 696,078

[22] Filed: Aug. 13, 1996

[51] Int. Cl.[6] ..... H01J 29/52

[52] U.S. Cl. ..... 313/477 R; 220/2.1 A

[58] Field of Search ..... 313/477 R; 220/2.1 A, 220/2.3 A

[56] References Cited

U.S. PATENT DOCUMENTS

| | | | |
|---|---|---|---|
| 2,969,162 | 1/1961 | Strutske | 220/2.1 |
| 3,005,122 | 10/1961 | Coleman et al. | 313/64 |
| 3,591,035 | 7/1971 | Gossie | 220/2.1 A |
| 3,720,345 | 3/1973 | Logue | 220/2.1 A |
| 3,934,169 | 1/1976 | Groothoff et al. | 313/477 R |
| 5,155,411 | 10/1992 | Swank et al. | 313/477 R |
| 5,258,688 | 11/1993 | Fondrk | 313/477 R |

*Primary Examiner*—Richard Chilcot
*Assistant Examiner*—Harshad Patel
*Attorney, Agent, or Firm*—Joseph S. Tripoli; Dennis H. Irlbeck; Vincent J. Coughlin, Jr.

[57] ABSTRACT

The present invention provides an improvement in a color picture tube 10 of a type that has a glass envelope 11 with a substantially rectangular faceplate panel 12, a funnel 16 and a neck 14. The glass envelope 11 has three orthogonal axes, a major axis, X—X, substantially parallel to a wider dimension of the faceplate panel 12, a minor axis, Y—Y, substantially parallel to a narrower dimension of the faceplate panel 12, and a longitudinal axis, Z—Z, extending through the center of the neck 14 and the center of the faceplate panel 12. The funnel 16 has a main body portion 30 and a yoke region 32 which is sealed to the neck 14. The weight of the funnel 16 is reduced by reducing the thickness of a sidewall 31 within the main body portion 30. An increase in tensile stress within the yoke region 32, that results from reducing the thickness of the sidewall 31 in the main body portion 30, is minimized by varying the thickness of a sidewall 33 in the yoke region 32, so that the greatest thickness in the sidewall 33 occurs in proximity to the major axis (X—X).

4 Claims, 5 Drawing Sheets

COLOR PICTURE TUBE HAVING IMPROVED FUNNEL

The invention relates to a color picture tube and, particularly, to a variation in the design of a funnel to reduce the weight and cost of the funnel, without substantially increasing the maximum tensile stress in the yoke region.

BACKGROUND OF THE INVENTION

A color picture tube has a glass envelope that comprises a neck, a funnel and a rectangular faceplate panel. The faceplate panel includes a viewing faceplate that is surrounded by a peripheral sidewall. The sidewall of the faceplate panel is sealed to a large end of the funnel by a glass frit. The surfaces of the facing ends of the panel sidewall and the funnel are called their seal lands. Adjacent to the seal land of the funnel is a main body portion which extends into a transition area, hereinafter referred to as the yoke area, before being sealed into the neck.

As color picture tubes are manufactured in larger sizes, each funnel also must be made correspondingly larger, thereby requiring more glass. The large quantity of glass required makes it more difficult to press the funnel and thereby increases the cost of the color picture tube. Thus, it is desirable to reduce the amount of glass in the funnel to decrease its weight and cost. However, removing glass from the funnel weakens it structurally and, in some instances, causes stresses to form, due to vacuum loading of the tube. If too much glass is removed, the funnel may become unsafe and subject to failure. The main body portion of the funnel is the logical area from which to remove glass; however, when glass is removed from this area, tensile stress in the yoke region increases to an unacceptable level. It is known in the art that the yoke region stress is the highest tensile stress in the funnel. For a funnel having a 68 cm (27V) diagonal dimension and a uniform cross sectional thickness of glass in the yoke region, the maximum tensile stress in the yoke region is about 120.93 kg/cm$^2$ (1720 psi). However, if the glass sidewall in the main body portion is thinned to achieve a weight reduction of about 11%, with no change in the sidewall thickness in the yoke region, the tensile stress in the yoke region increases by about 15% to about 138.5 kg/cm$^2$ (1970 psi). Therefore, there is a need for a new funnel design that will reduce weight and cost, while strength is retained, without substantially increasing the tensile stress in the yoke region.

SUMMARY OF THE INVENTION

The present invention provides an improvement in a color picture tube of a type that includes a glass envelope with a substantially rectangular faceplate panel, a funnel and a neck. The glass envelope has three orthogonal axes, a major axis substantially parallel to a wider dimension of the faceplate panel, a minor axis substantially parallel to a narrower dimension of the faceplate panel, and a central longitudinal axis which extends through the center of the neck and the center of the panel. The funnel has a main body portion, and a yoke region which is sealed to the neck. The main body portion of the funnel has a first sidewall of reduced thickness. The yoke region of the funnel has a second sidewall of varying thickness, wherein the greatest sidewall thickness occurs in proximity to the major axis.

BRIEF DESCRIPTION OF THE DRAWINGS

The invention will now be described in greater detail, with relation to the accompanying drawings, in which.

DETAILED DESCRIPTION OF THE PREFERRED EMBODIMENT

Figure 1:
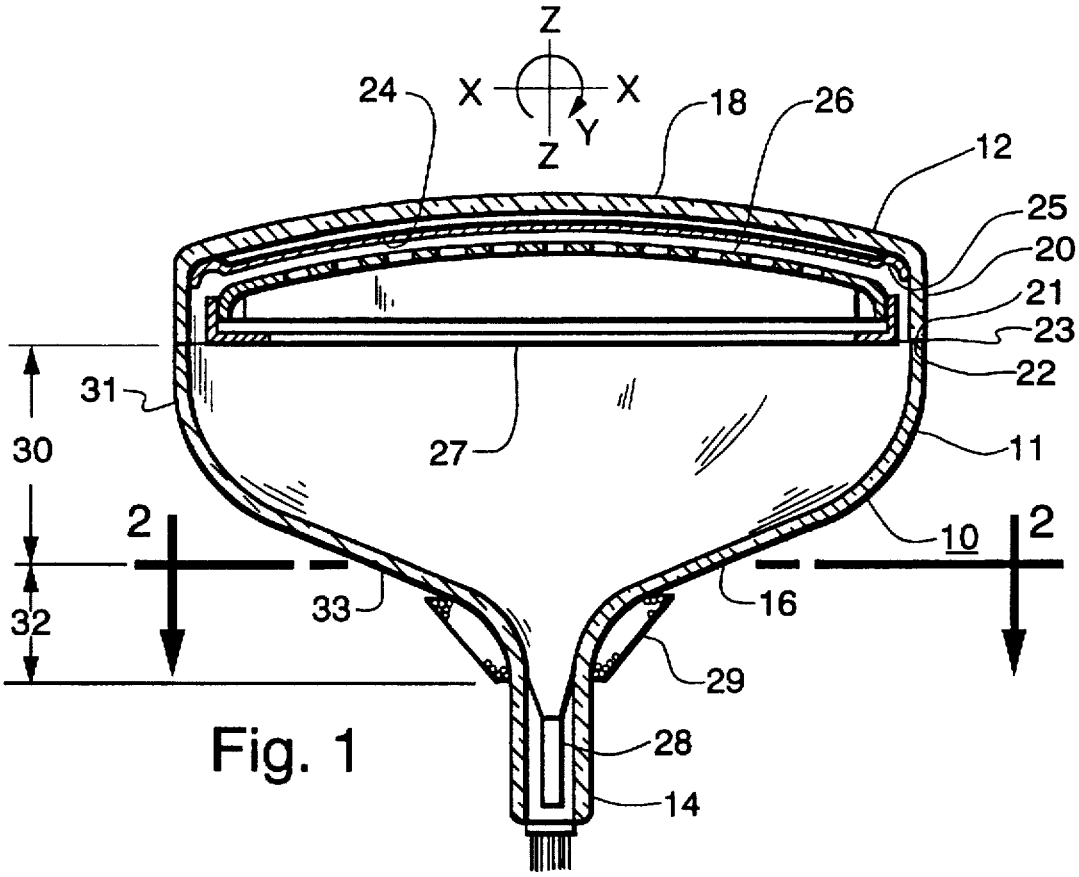
FIG. 1 is a partially cut away view of a CRT having a funnel according to the present invention.

FIG. 1 shows a rectangular color CRT 10 having a glass envelope 11 comprising a substantially rectangular faceplate panel 12 and a tubular neck 14 connected by a rectangular funnel 16. The panel 12 comprises a viewing faceplate 18, and a sidewall 20 which includes a panel seal land 21. The panel seal land 21 is sealed to a corresponding funnel seal land 22 by a frit seal 23. The envelope 11 includes three orthogonal axes: a major axis X—X, parallel to a wider dimension (usually horizontal) of the panel 12, a minor axis Y—Y, parallel to a narrower dimension (usually vertical) of the panel 12, and a central longitudinal axis Z—Z which extends through the center of the neck 14 and the center of the panel 12. A three-color luminescent phosphor screen 24 is provided on the interior surface of the panel 12. The screen 24, preferably, is a line screen with the phosphor lines extending substantially parallel to the minor axis, Y—Y. Alternatively, the screen may be a dot screen. A thin layer of metal, such as aluminum, 25 overlies the luminescent phosphor screen 24 and, in combination therewith, forms a luminescent screen assembly. A multiapertured color selection electrode, such as a shadow mask, 26 is attached to a frame 27 and removably mounted, by conventional means, not shown, in predetermined spaced relation to the luminescent screen assembly. An electron gun 28 is centrally mounted within the neck 14, to generate and direct three electron beams, also not shown, along convergent paths through openings in the shadow mask 26, to the screen 24. The tube 10 is designed to be used with an external magnetic deflection yoke, such as yoke 29, located in the neighborhood of the funnel-to-neck junction. When activated, the yoke 29 subjects the three electron beams to magnetic fields which cause the beams to scan horizontally and vertically in a rectangular raster over the screen 24.

Figure 2:
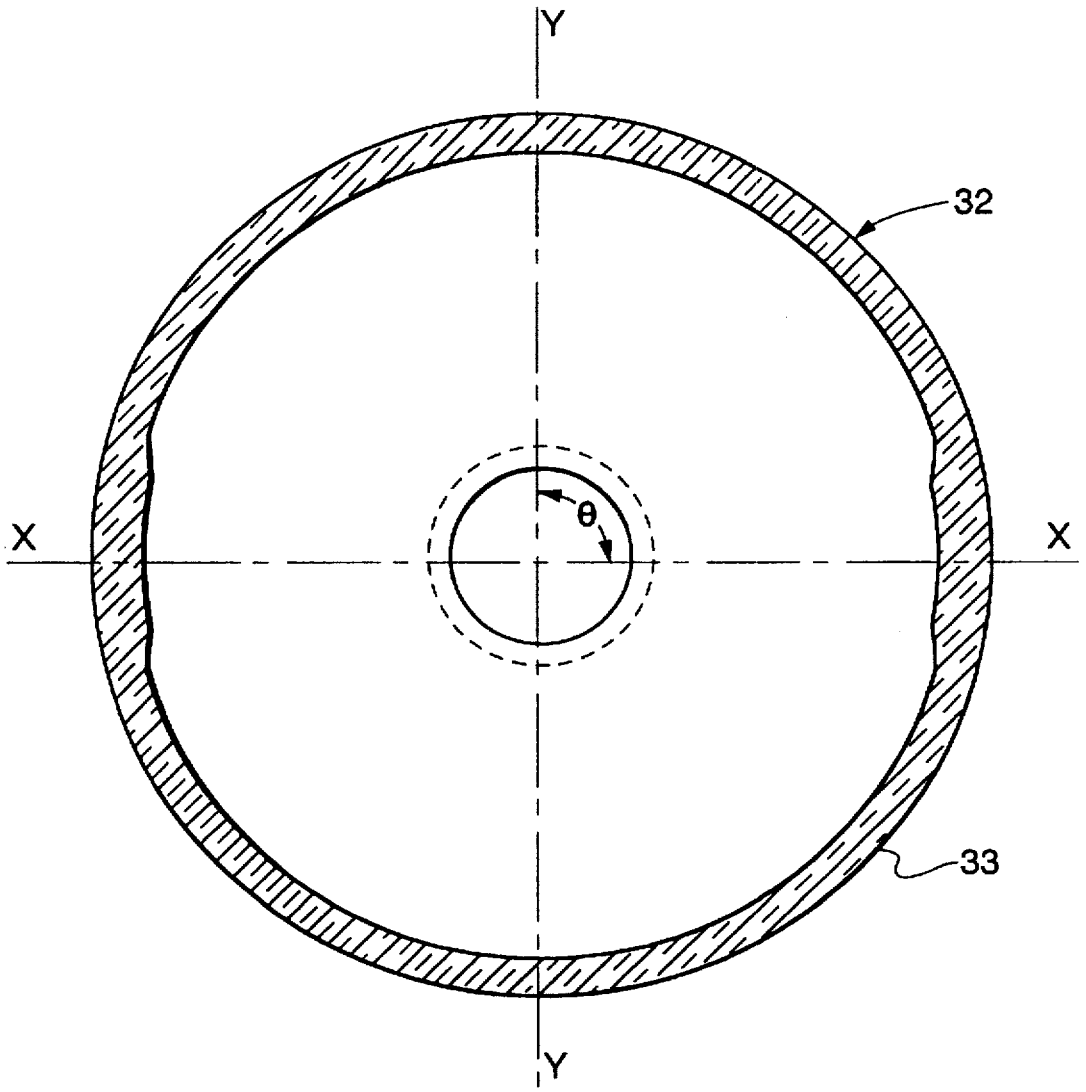
FIG. 2 is an enlarged sectional view of the funnel of the present invention, taken along line 2—2 of FIG. 1.
Figure 3:
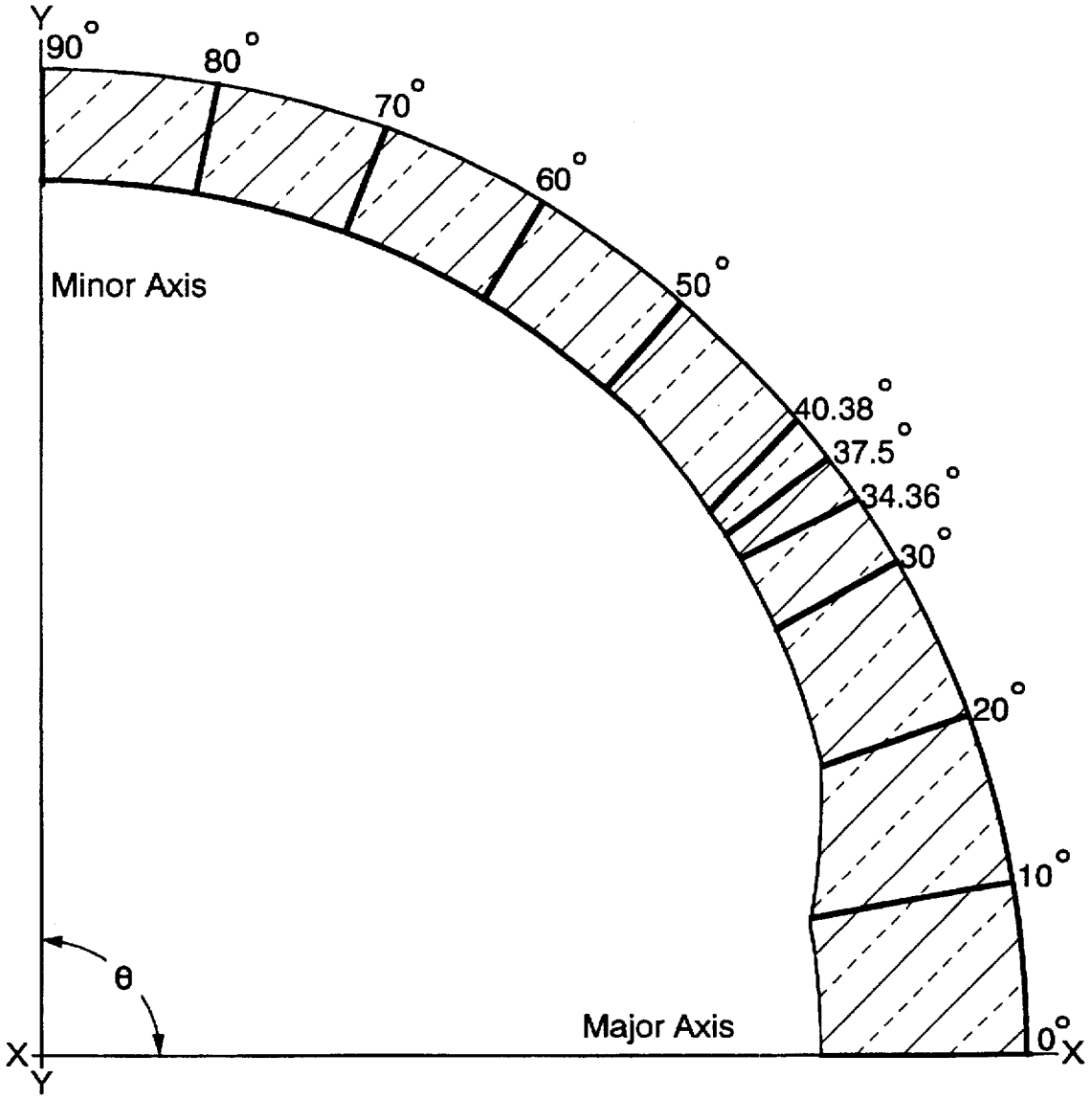
FIG. 3 is sectional view of a quadrant of the funnel of the present invention.

The funnel 16 includes a main body portion 30 which extends from the seal land 22 at one end to a yoke region 32 that is sealed to the neck 14. In a tube having a diagonal dimension of 68 cm (27 inches), the main body portion extends about 12.7 to about 13.3 cm from the seal land 22 of the funnel 16 along the z-axis. The yoke region 32 extends from the main body portion 30 to about 22 cm, along the z-axis from the seal land 22, to the neck 14. In order to decrease the weight of the funnel 16 without substantially increasing the tensile stress therein, a sidewall 31 of the main body portion 30 of the funnel 16 has been non-uniformly decreased in thickness, relative to that of a conventional funnel. Additionally, a sidewall 33 in the yoke region 32, in the vicinity of the major axis, X—X has been substantially increased in thickness, relative to that of a conventional funnel, while the thickness of the sidewall 33 elsewhere in the yoke region is substantially unchanged from that of the conventional funnel. A conventional funnel for a 68 cm tube has a nominal weight of about 7.71 kilograms (kg), whereas the weight of the novel funnel 16 is about 6.89 kg. FIG. 2 shows a cross section of the novel funnel 16 in the yoke region 32, at a plane extending about 19 cm (7.5 inch) from the seal land 22. A quadrant of the cross section of FIG. 2 is enlarged and shown in FIG. 3. The thickness of the sidewall 33, as a function of the angle θ from the major axis, for the quadrant shown in FIG. 3, is listed in the TABLE. As shown in FIGS. 2 and 3, the increase in the thickness of the sidewall 33, in the yoke region 32, is restricted to the interior surface.

TABLE

NON-UNIFORM YOKE REGION

| Angle w/ Major Axis (degrees θ) | Thickness (cm) | % of Major Axis Thickness |
|---|---|---|
| 0.00 | 0.57 | 100.0 |
| 10.00 | 0.57 | 100.0 |
| 20.00 | 0.44 | 77.5 |
| 30.00 | 0.39 | 68.4 |
| 34.36 | 0.35 | 61.5 |
| 37.50 | 0.35 | 61.2 |
| 40.38 | 0.35 | 61.7 |
| 50.00 | 0.31 | 55.2 |
| 60.00 | 0.31 | 55.2 |
| 70.00 | 0.31 | 55.2 |
| 80.00 | 0.31 | 55.2 |
| 90.00 | 0.31 | 55.2 |

Figure 4:
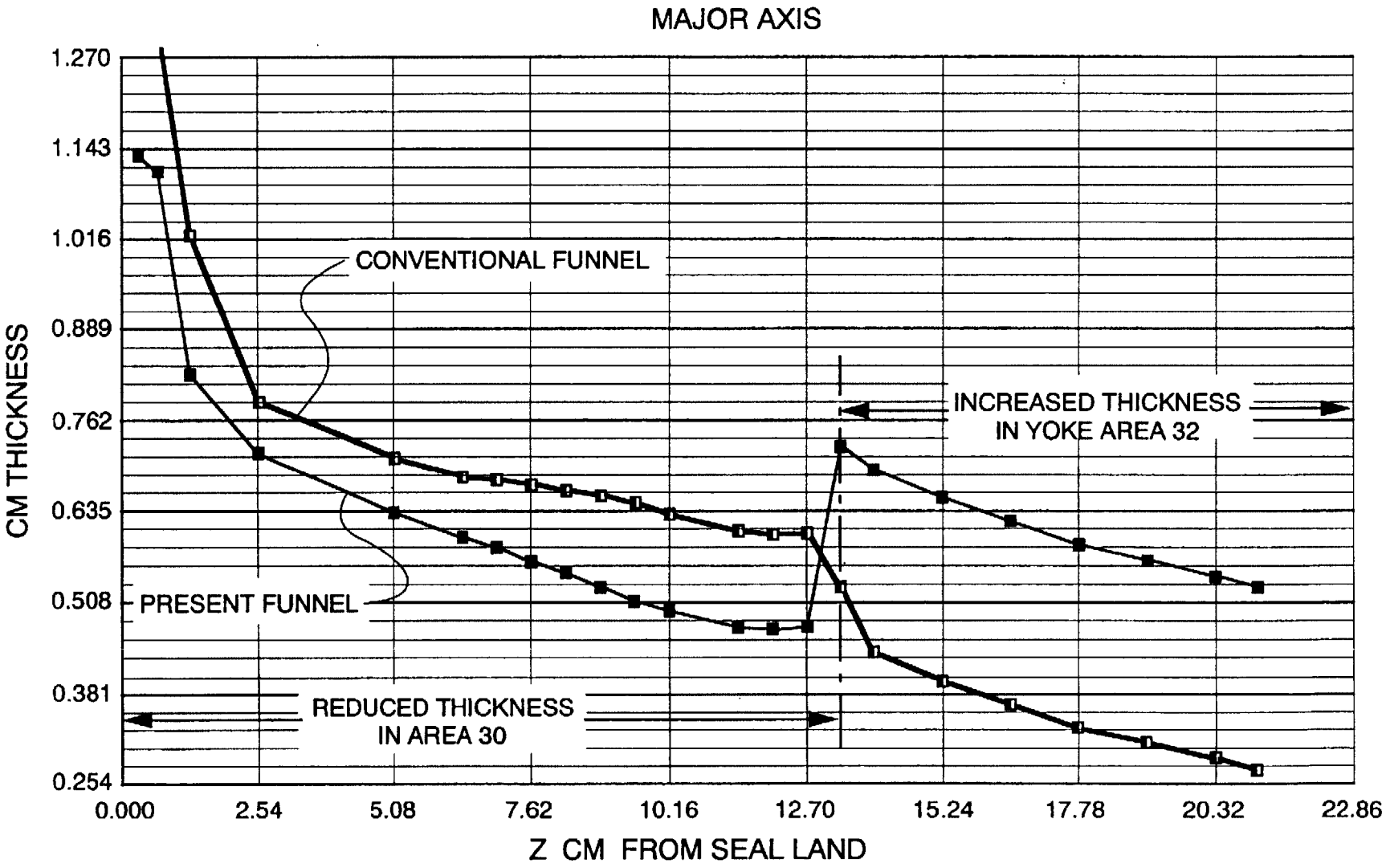
FIG. 4 is a graph of the sidewall thickness, taken along the major axis, of a conventional funnel and of the funnel of the present invention.
Figure 5:
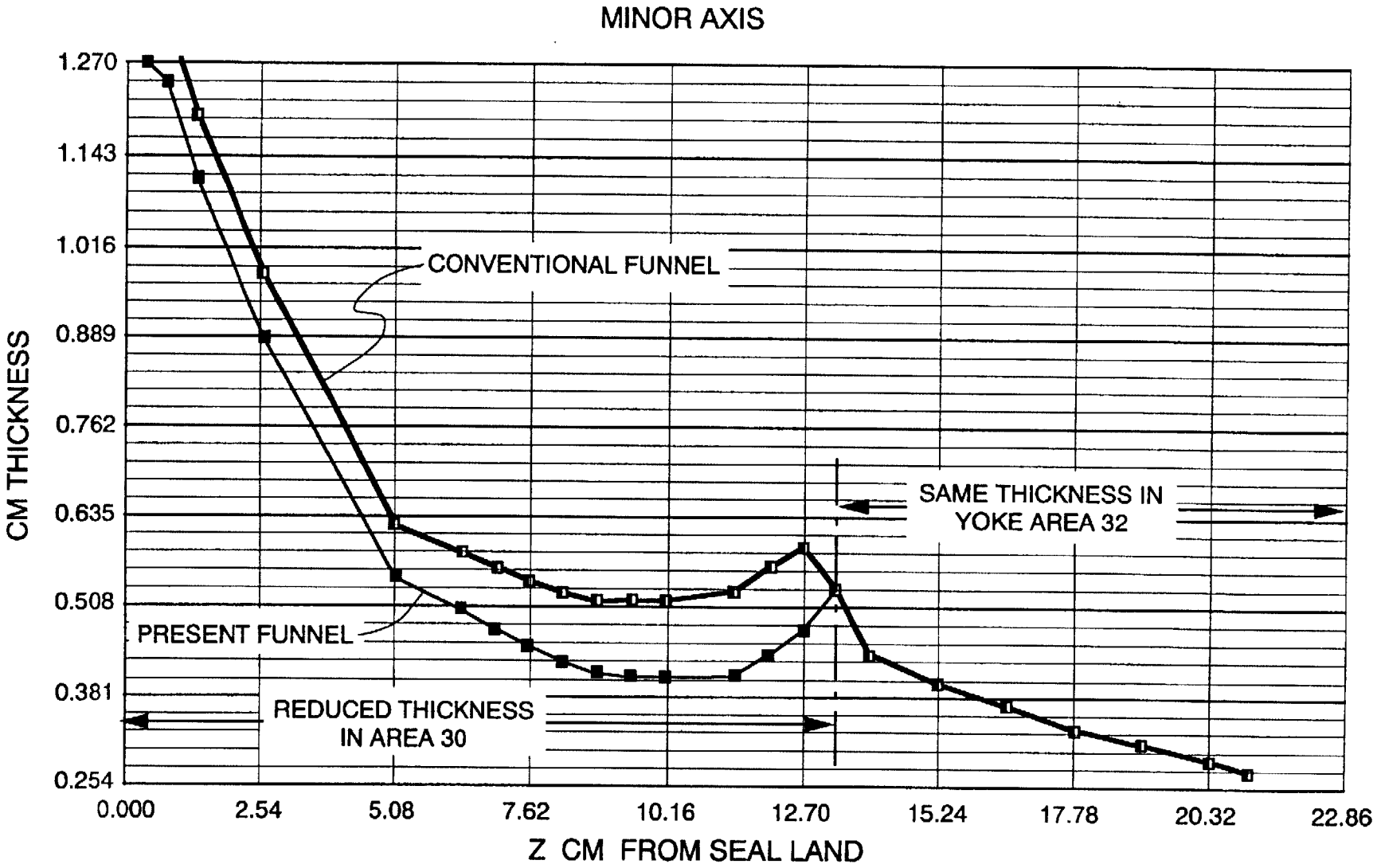
FIG. 5 is a graph of the sidewall thickness, taken along the minor axis, of the conventional funnel and of the funnel of the present invention.

The non-uniform thickness of the sidewall 33 in the yoke region 32, in conjunction with the reduction in the thickness of the sidewall 31 in the main body portion 30, provides an 11% reduction in funnel weight, but only a 2% increase in tensile stress, compared to a conventional funnel. The tensile stress is measured on the exterior surface of the funnel 16, in the yoke region 32, at the area of maximum stress, i.e., adjacent to the major axis. The tensile stress in the yoke region of the conventional funnel, used in a 68 cm tube, is a maximum of 120.93 kg/cm$^2$ (1720 psi); whereas, the stress in the present funnel, for the same size tube, is a maximum of 123.74 kg/cm$^2$ (1760 psi). A comparison of the thickness of the sidewall of a conventional funnel with that of the present funnel, along the major axis, is shown in FIG. 4. It is evident from FIG. 4 that, at all points within the main body portion 30, from the seal land 22 to the beginning of the yoke region 32, the present funnel 16 has a thinner sidewall 31 than the conventional funnel. However, within the yoke region 32 the thickness of the sidewall 33 is substantially greater than that of the conventional funnel. With reference to FIG. 5, which shows the sidewall thickness along the minor axis, at all points within the main body portion 30, from the seal land 22 to the beginning of the yoke region 32, the present funnel 16 has a thinner sidewall 31 than the conventional funnel. However, within the yoke region 32, the thickness of the sidewall 33 is substantially equal to that of the conventional funnel. Because the main body portion 30 of the funnel provides the greatest contribution to its weight, the present funnel is about 11% lower in weight but has only about 2% more tensile stress in the yoke region 32 than a conventional funnel.

What is claimed is:

1. In a color picture tube having a glass envelope comprising a substantially rectangular faceplate panel, a funnel and a neck, said glass envelope having three orthogonal axes, a major axis substantially parallel to a wider dimension of said faceplate panel, a minor axis substantially parallel to a narrower dimension of said faceplate panel, and a longitudinal axis extending through the center of said neck and the center of said faceplate panel, said funnel having a main body portion and a yoke region which is sealed to said neck, said main body portion extending from a seal land to said yoke region, wherein the improvement comprises said main body portion of said funnel having a first sidewall of varying thickness, wherein said thickness along said major axis, adjacent to said seal land, is less than said thickness along said minor axis, adjacent to said seal land, and said thickness adjacent to said yoke region along said major and minor axes is less than said thickness' adjacent to said seal land along said major and minor axes, and said yoke region having a second sidewall of varying thickness, wherein the greatest thickness occurs in proximity to said major axis.

2. The tube as described in claim 1, wherein said second sidewall has a maximum thickness which occurs within about ±10 degrees of said major axis.

3. The tube as described in claim 2, wherein said second sidewall has a thickness in said yoke region, within about ±40 degrees of the minor axis, of about 55% of said maximum thickness at said major axis.

4. The color picture tube as described in claim 1, wherein said first sidewall of said main body portion of said funnel varies in thickness along said major axis, from about 1.14 cm, adjacent to said seal land, to about 0.48 cm adjacent to said yoke region, and along said minor axis, from about 1.27 cm, adjacent to said seal land, to about 0.48 cm adjacent to said yoke region.

* * * * *